US008646442B2

(12) United States Patent
Manohar et al.

(10) Patent No.: US 8,646,442 B2
(45) Date of Patent: Feb. 11, 2014

(54) CLAMSHELL HEAT EXCHANGER

(75) Inventors: Shailesh S Manohar, Coppell, TX (US); Glenn W Kowald, Carrollton, TX (US); Floyd E Cherington, Carrollton, TX (US); Hans J Paller, Double Oak, TX (US); John W Whitesitt, Garland, TX (US); Jianmin Zhang, Greer, SC (US)

(73) Assignee: Lennox Industries Inc., Richardson, TX (US)

( * ) Notice: Subject to any disclaimer, the term of this patent is extended or adjusted under 35 U.S.C. 154(b) by 437 days.

(21) Appl. No.: 12/834,614

(22) Filed: Jul. 12, 2010
(Under 37 CFR 1.47)

(65) Prior Publication Data

US 2011/0174291 A1 Jul. 21, 2011

Related U.S. Application Data

(60) Provisional application No. 61/295,501, filed on Jan. 15, 2010.

(51) Int. Cl.
*F24H 3/02* (2006.01)

(52) U.S. Cl.
USPC ..... 126/112; 126/110 R; 165/170; 29/890.03

(58) Field of Classification Search
USPC ..... 126/112, 116 R, 110 R, 99 R, 99 C; 165/170, 159, 185, 146, 147
See application file for complete search history.

(56) References Cited

U.S. PATENT DOCUMENTS

| | | | | |
|---|---|---|---|---|
| 5,359,989 | A * | 11/1994 | Chase et al. | 126/110 R |
| 5,799,646 | A | 9/1998 | Zia et al. | |
| 6,006,741 | A | 12/1999 | Daddis, Jr. | |
| 6,564,795 | B1 | 5/2003 | Sears et al. | |
| 2003/0127218 | A1 | 7/2003 | Sears et al. | |

FOREIGN PATENT DOCUMENTS

| | | | |
|---|---|---|---|
| EP | 1318362 | A2 | 11/2003 |

* cited by examiner

*Primary Examiner* — Alfred Basichas

(57) ABSTRACT

A clamshell heat exchanger for use in a gas-fired direct combustion furnace. The exchanger comprises a first clamshell half and a second clamshell half that when joined with the first clamshell half forms a passageway having an inlet and an outlet. The passageway includes a U-bend located between the inlet and the outlet, wherein the U-bend includes a re-entrant sectional profile.

14 Claims, 15 Drawing Sheets

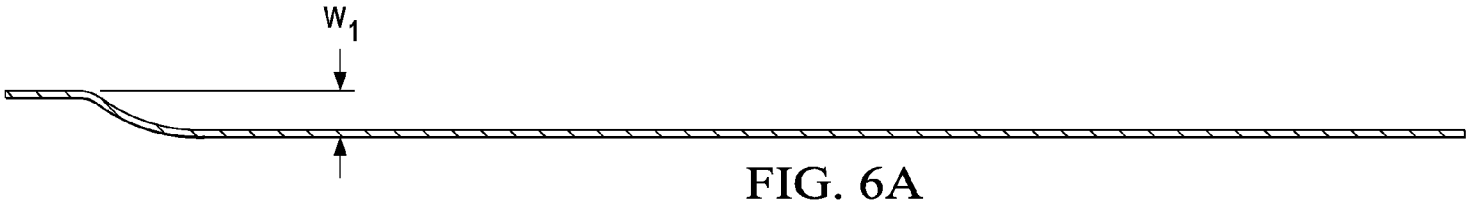
FIG. 6A
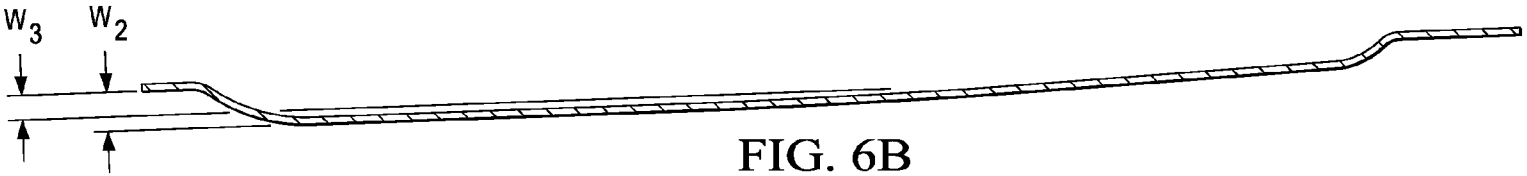
FIG. 6B
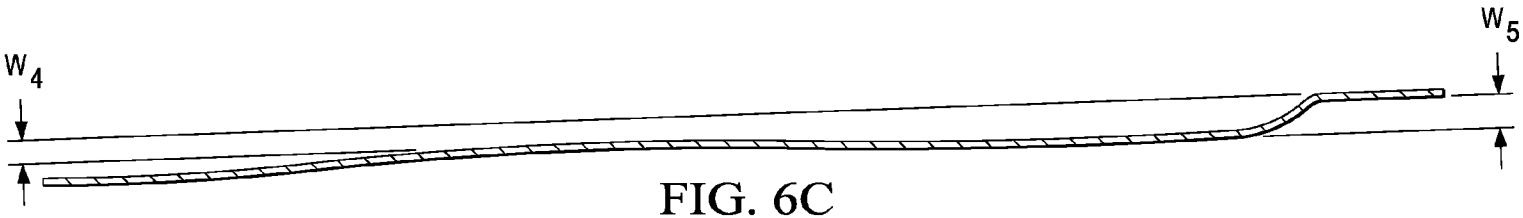
FIG. 6C
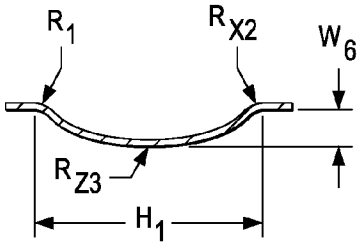
FIG. 6D
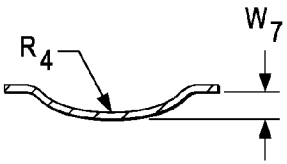
FIG. 6E
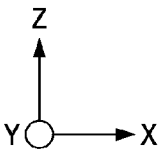

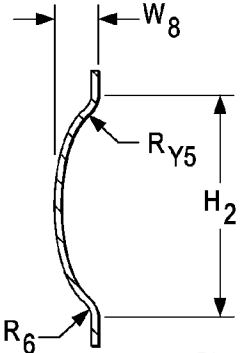
FIG. 7A
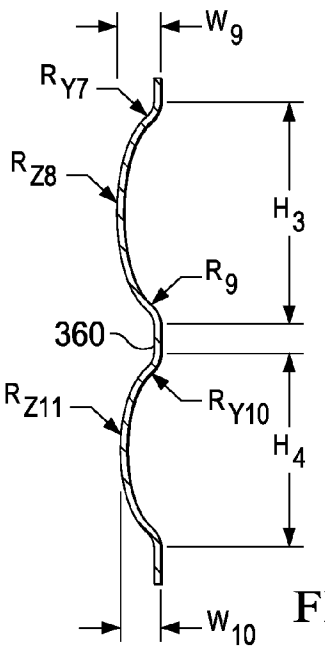
FIG. 7B
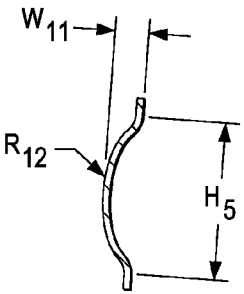
FIG. 7C
FIG. 7D
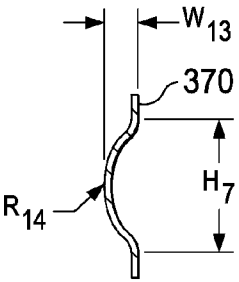
FIG. 7E
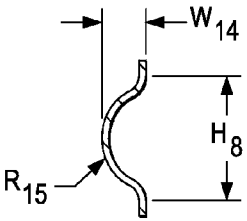
FIG. 7F
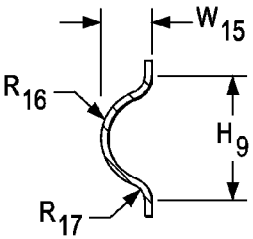
FIG. 7G
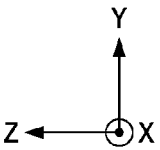

CLAMSHELL HEAT EXCHANGER

CROSS-REFERENCE TO RELATED APPLICATION

This application claims the benefit of U.S. Provisional Application Ser. No. 61/295,501, filed by Shailesh S. Manohar, et al., on Jan. 15, 2010, entitled "An Improved Heating Furnace for a HVAC System", and incorporated herein by reference in its entirety.

TECHNICAL FIELD OF THE INVENTION

The present invention is directed, in general to an HVAC system, and more specifically, to a clamshell heat exchanger.

BACKGROUND OF THE INVENTION

A high-efficiency furnace typically employs several heat exchangers to warm an air stream passing through the furnace. The heat exchanger may include "clamshell" halves formed by shaping metal sheets, the halves being fastened together in a clamshell assembly to form a passageway through which burning fuel and hot flue gas pass during operation of the furnace.

SUMMARY OF THE INVENTION

In one aspect the present disclosure provides a clamshell heat exchanger that may be used in a gas-fired direct combustion furnace. The heat exchanger includes a first clamshell half and a second clamshell half. When joined, the first and second clamshell halves form a passageway having an inlet and an outlet. The passageway has a height and a depth. A ratio of the height to the depth is about 0.5 or less. The heat exchanger has an efficiency of at least about 70%.

In other aspect, the disclosure provides a furnace. The furnace includes a cabinet and a heat exchanger assembly located within the cabinet. A blower is located to move air through the cabinet and over the heat exchanger assembly. A clamshell heat exchanger is located within the heat exchanger assembly. The clamshell heat exchanger includes a first clamshell half and a second clamshell half. When joined the first and second clamshell halves form a passageway having an inlet and an outlet. The passageway has a height and a depth. A ratio of the height to the depth is about 0.5 or less, and the heat exchanger has an efficiency of at least about 70%.

In yet another aspect, a method of manufacturing a heat exchanger is provided. The method includes providing a sheet metal blank, and shaping the blank to form a first clamshell half and a second clamshell half. When joined the first and second clamshell halves form a passageway having an inlet and an outlet. The passageway has a height and a depth. A ratio of the height to the depth is about 0.5 or less. The heat exchanger has an efficiency of at least about 70%.

BRIEF DESCRIPTION OF THE DRAWINGS

For a more complete understanding of the present invention, reference is now made to the following descriptions taken in conjunction with the accompanying drawings, in which:

FIGS. 5, 6A-6E and 7A-7G with Table II present various illustrative dimensions of a serpentine heat exchanger, e.g. the heat exchanger of FIG. 3;

DETAILED DESCRIPTION

Figure 1:
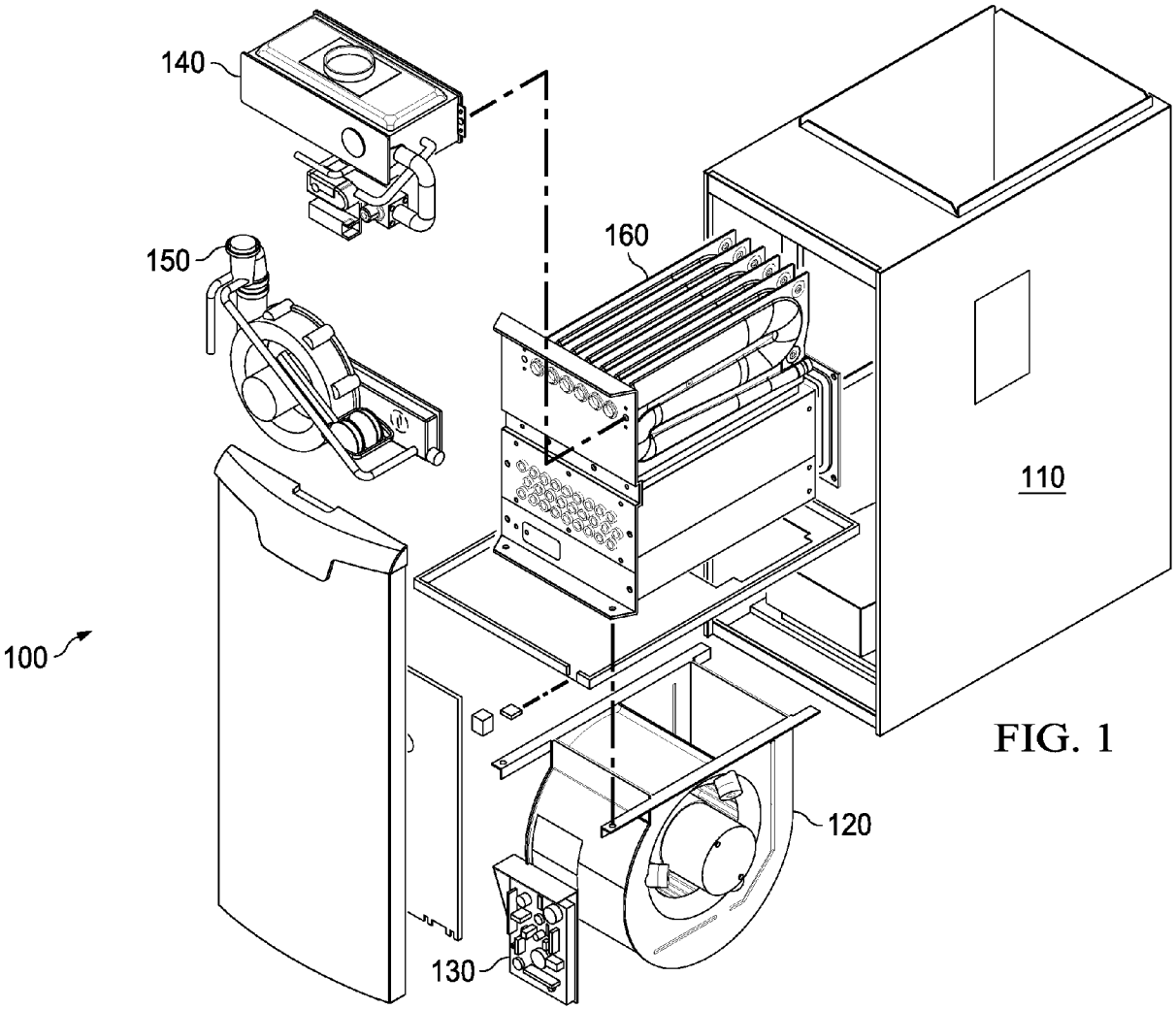
FIG. 1 illustrates a furnace of the disclosure.

Referring initially to FIG. 1, illustrated is a furnace 100 of the disclosure. The furnace 100 is described without limitation in terms of a gas-fired system. Those skilled in the pertinent art will appreciate that the principles disclosed herein may be extended to furnace systems using other fuel types. The furnace 100 includes various subsystems that may be conventional. A cabinet 110 encloses a blower 120, a controller 130, a burner assembly 140, and a combustion air inducer 150. The burner assembly 140 may optionally be enclosed in a burner box as illustrated. A heat exchanger assembly 160 is configured to operate with the burner assembly 140 and the combustion air inducer 150 to burn a heating fuel, e.g. natural gas, and move exhaust gases through the heat exchanger assembly 160. The controller 130 may further control the blower 120 to move air over the heat exchanger assembly 160, thereby transferring heat from the exhaust gases to the airstream.

Figure 2:
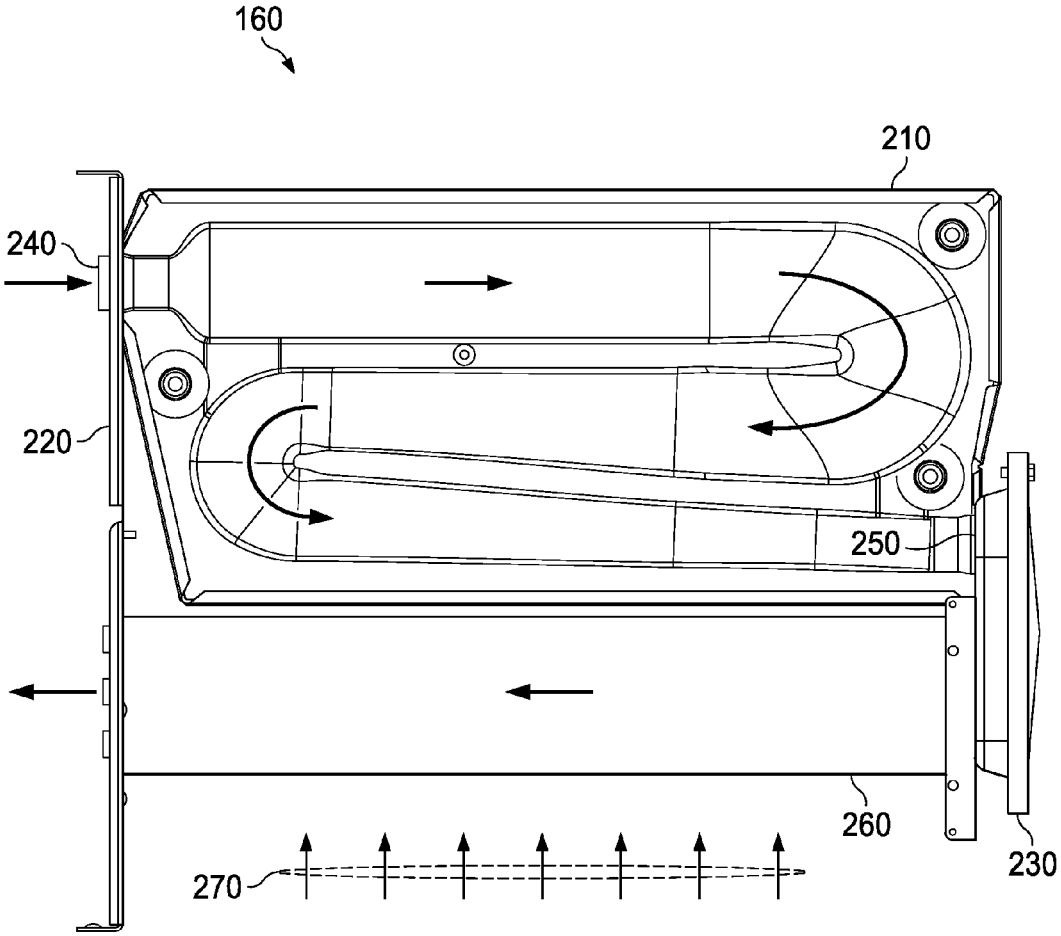
FIG. 2 illustrates a heat exchanger assembly of the disclosure that may be used, e.g. in the furnace of FIG. 1.

FIG. 2 presents a side view of the heat exchanger assembly 160. The heat exchanger assembly 160 is illustrated by way of example without limitation to a particular configuration of a plurality of heat exchangers 210 and associated components. The heat exchanger 210 is representative of each heat exchanger of the plurality of heat exchangers 210. The heat exchanger 210 is joined to a vest panel 220 and a collector box manifold 230. The burning fuel stream enters the heat exchanger 210 at an inlet 240. Exhaust gas leaves the heat exchanger 210 at an outlet 250 and is drawn through a secondary heat exchanger 260 by the combustion air inducer 150. The plurality of heat exchangers 210 heat an airstream 270 forced over the exchanger assembly 160 by the blower 120.

In some cases the vertical dimensions (height) of the furnace 100 is constrained to provide space for other HVAC components in a limited space, such as a furnace closet. Such other components may include, e.g., an air filter, a sterilizer, or an air conditioning coil. To accommodate such installation options, the height of the heat exchanger 210 may be constrained. Such a constraint limits the space available to recover heat from the heat exchanger 210. Various embodiments described herein make possible the recovery of heat that might otherwise be lost due to such size constraints.

Unlike heat exchangers of the disclosure, a conventional heat exchanger typically has dimensions that are relatively unconstrained such as by the factors previously described. Thus, a manufacturer of the conventional heat exchanger may provide a high efficiency of the conventional heat exchanger by relatively simple techniques, such as increasing the path length of a heat exchanger passage. When heat exchanger dimensions are constrained, however, it may be difficult, impractical or impossible to attain a desired efficiency by conventional approaches.

Figure 3:
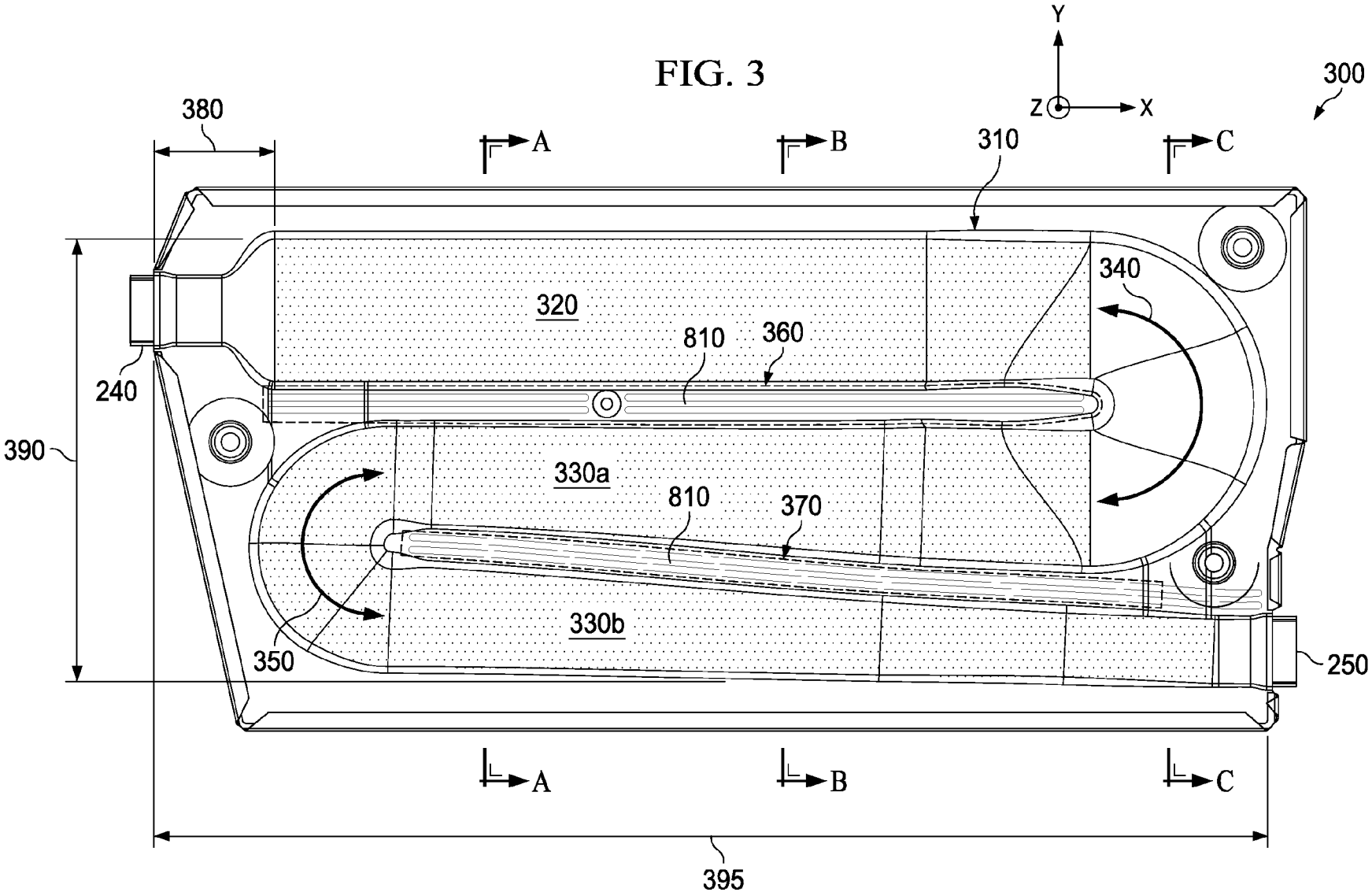
FIG. 3 illustrates a serpentine heat exchanger of the disclosure, e.g. one of the heat exchangers in the assembly of FIG. 2.

FIG. 3 presents without limitation an illustrative embodiment of a heat exchanger 300 that may be used for the heat exchanger 210. Coordinate xyz axes are illustrated for reference. Advantageously, the heat exchanger 300 is configured to provide an efficiency of at least about 70%, meaning that at least about 70% of the heat produced by burning fuel entering the inlet 240 is transferred to the airstream 270. The heat exchanger 300 includes a passageway 310 between the inlet 240 and the outlet 250. The passageway 310 includes a combustion region 320 in which fuel and air burn. Exhaust gases flow through a first exhaust region 330*a* and a second exhaust region 330*b*, collectively referred to as the exhaust region 330. The heat exchanger 300 is illustrative of embodiments of a serpentine passageway, e.g. wherein the passageway 310 includes at least two changes of direction, such as U-bends 340, 350.

Herein, a U-bend is a section of the passageway 310 configured to change an overall direction of gas flow with the passageway 310 by at least about 120°. In various embodiments, the change of direction is preferably at least about 150°, while in other embodiments 180° is more preferred.

The region in which the fuel burns typically extends beyond the combustion region 320 into the U-bend 340. Thus, unless stated otherwise, the U-bend 340 is also considered a combustion region for the purposes of the disclosure and the claims.

A first seal region 360 substantially prevents gas from bypassing the U-bend 340. A second seal region 370 substantially prevents gas from bypassing the U-bend 350. In some embodiments, as illustrated, an optional interference pattern 810 is located within the first seal region 360 and/or the second seal region 370. The interference pattern 810 is discussed briefly herein with respect to FIG. 8, and in greater detail in co-pending application Ser. No. 12/834,145, incorporated herein by reference.

An inlet region 380 provides an initial path for a burning fuel/air mixture to enter the combustion region 320. The inlet region 380 is discussed briefly herein with respect to FIG. 9, and in greater detail in co-pending application Ser. No. 12/834,123, incorporated herein by reference.

The heat exchanger 300 may be formed by shaping a sheet metal blank to form two "clamshell" halves. Those skilled in the pertinent art are knowledgeable regarding the specifics of metal shaping, such as by stamping. In illustrative embodiments, the clamshells halves may be formed from 0.74 mm (29 mil) T1-40 EDDS aluminized steel, 0.74 mm (29 mil) 409 stainless steel, 0.86-0.91 mm (34-36 mil) aluminized type 1 DQHT steel, or 0.74 mm (29 mil) aluminized type 1 DQHT steel. Each of the above thicknesses is approximate, allowing for typical supplier tolerances.

The clamshell halves may be formed such that the first seal region 360 of one clamshell half, as indicated in FIG. 7B, meets a corresponding first seal region 360 of the other clamshell half. In some cases, it may be preferred that the heat exchanger 300 be formed such that the first seal regions 360 of opposing clamshell halves interfere with one another when the clamshell halves are joined. The interference causes a tight metal-on-metal seal in the first seal region 360, limiting the leakage of gas from the combustion region 320 to the first exhaust region 330*a*. The second seal region 370, indicted in FIG. 7E, may be similarly formed.

Figure 14:
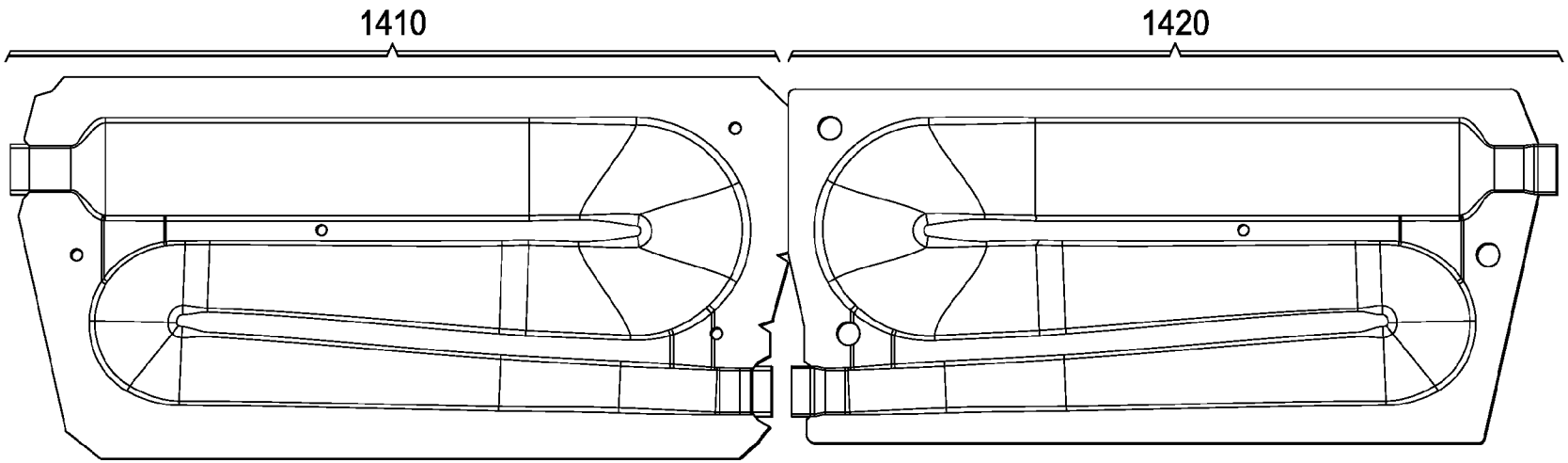
FIG. 14 illustrates two clamshell halves shaped to form a heat exchanger when joined, such as the heat exchanger of FIG. 3.

As described earlier the heat exchanger 300 may be formed from two clamshell halves. Referring briefly to FIG. 14, illustrated is a first clamshell half 1410 and a second clamshell half 1420. Illustratively the clamshell halves 1410, 1420 may be formed from a continuous workpiece of sheet metal, such as any of the previously described sheet metal types. The clamshell halves 1410, 1420 may be separated at a shear line and joined by, e.g. edge crimping to form the heat exchanger 300. The clamshell halves 1410, 1420 may have any combination of bosses and indentations, for example the various features described in FIGS. 5, 6A-6E, 7A-7G, 8, 9 10A, 10B, 11A-11C, and 12A-12E.

Referring back to FIG. 3, the heat exchanger 300 may be characterized by an aspect ratio, e.g. a height 390 divided by a depth 395. Herein and for the purpose of the claims, the height 390 is the distance between the uppermost extent (positive y-direction) and the lowermost extent (negative y-direction) of the passageway 310. The depth 395 is the distance (in the x-direction) between the beginning of the passageway 310 at the inlet 240 and the end of the passageway 310 at the outlet 250.

While the dimensions of the heat exchanger 300 are not limited to any particular values, in various embodiments the aspect ratio is about 0.5 or less. Restated, in such embodiments the height 390 is no greater than about one-half the depth 395. In some embodiments, various dimensions of the heat exchanger 300 are compatible with industry-standard furnace cabinet dimensions. For example, in such embodiments the depth 395 may be accommodated in a standard depth of the cabinet 110. In some embodiments the height 390 of the heat exchanger 300 is about 21.5 cm (about 8.5 inches) and the depth D is about 47 cm (about 18.5 inches). In this illustrative embodiment the aspect ratio is about 0.46.

Those skilled in the pertinent art appreciate that additional heat may be extracted from the exhaust downstream from the heat exchanger 300. Such subsequent heat recovery, in addition to the at least about 70% recovered heat from the heat exchanger 300, may result in an overall efficiency of the furnace 100 of at least about 90% is some embodiments. Such a high efficiency from a furnace having the compact characteristics of the heat exchanger 300 is unknown to the inventors, and represents a significant advance in the state of the art of high-efficiency furnace design.

Figure 4A:
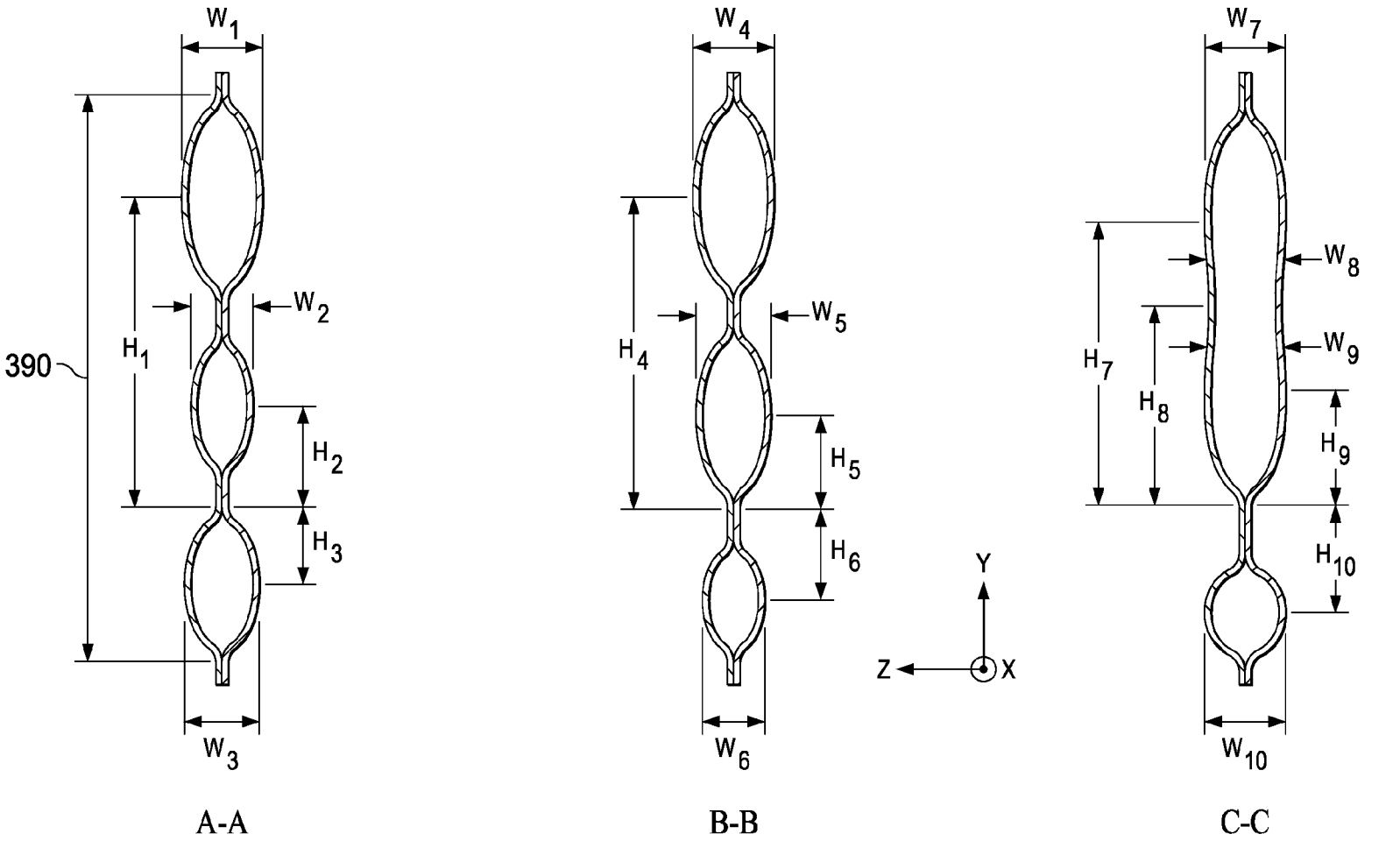
FIGS. 4A and 4B illustrate sectional views of a passageway of the serpentine heat exchanger of FIG. 3.

FIG. 4A illustrates cross-sections A-A, B-B and C-C of the passageway 310 as indicated in FIG. 3 with dimension references shown. Coordinate xyz axes are illustrated for reference. Table I presents without limitation illustrative corresponding dimensions of the cross-sections. Table I includes an example range, a preferred range and a more preferred range for each dimensional reference. The specific values are presented by way of example of an illustrative embodiment of the heat exchanger 300. Those skilled in the pertinent art will appreciate that values provided in Table I may be modified such as by scaling the height 390 and/or the depth 395 without departing from the scope of the disclosure and the claims.

TABLE I

FIG. 4A Illustrative Dimensions

| Dimension | Nominal Value (cm) | Example Tolerance (mm) | Preferred Tolerance (mm) | More Preferred Tolerance (mm) |
|---|---|---|---|---|
| $W_1$ | 2.57 | ±2.5 | ±1.3 | ±0.76 |
| $W_2$ | 1.82 | ±2.0 | ±1.3 | ±0.76 |

TABLE I-continued

| FIG. 4A Illustrative Dimensions | | | | |
|---|---|---|---|---|
| Dimension | Nominal Value (cm) | Example Tolerance (mm) | Preferred Tolerance (mm) | More Preferred Tolerance (mm) |
| $W_3$ | 2.18 | ±2.5 | ±1.3 | ±0.76 |
| $W_4$ | 2.57 | ±2.0 | ±1.3 | ±0.76 |
| $W_5$ | 2.34 | ±2.0 | ±1.3 | ±0.76 |
| $W_6$ | 1.75 | ±2.0 | ±1.3 | ±0.76 |
| $W_7$ | 2.57 | ±2.5 | ±1.3 | ±0.76 |
| $W_8$ | 2.30 | ±2.0 | ±1.3 | ±0.76 |
| $W_9$ | 2.57 | ±2.0 | ±1.3 | ±0.76 |
| $W_{10}$ | 2.45 | ±2.0 | ±1.3 | ±0.76 |
| $H_1$ | 10.16 | ±2.0 | ±1.3 | ±0.76 |
| $H_2$ | 3.51 | ±2.0 | ±1.3 | ±0.76 |
| $H_3$ | 2.22 | ±2.0 | ±1.3 | ±0.76 |
| $H_4$ | 10.16 | ±2.0 | ±1.3 | ±0.76 |
| $H_5$ | 3.05 | ±2.0 | ±1.3 | ±0.76 |
| $H_6$ | 2.81 | ±2.0 | ±1.3 | ±0.76 |
| $H_7$ | 9.01 | ±2.0 | ±1.3 | ±0.76 |
| $H_8$ | 6.31 | ±2.0 | ±1.3 | ±0.76 |
| $H_9$ | 3.80 | ±2.0 | ±1.3 | ±0.76 |
| $H_{10}$ | 3.44 | ±2.0 | ±1.3 | ±0.76 |

Figure 4B:
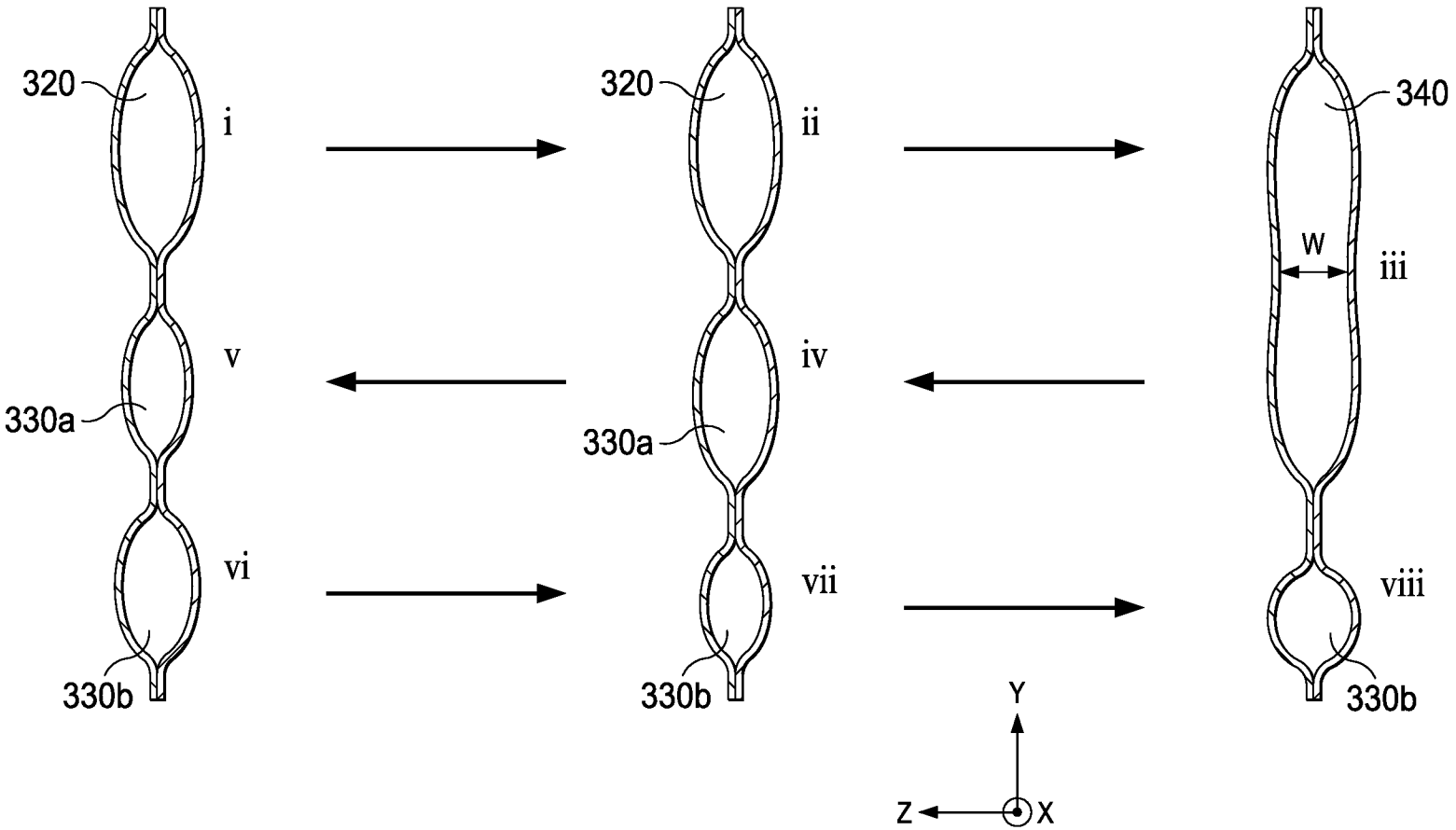

FIG. 4B illustrates a simplified view of the cross-sections A-A, B-B and C-C, annotated to illustrate relationships between portions of the passageway 310. Arrows indicate the order of passage of combustion/exhaust gases through each cross-section. Thus, the gases pass through the sections in the order of i→ii→iii→iv→v→vi→vii→viii. Sections i and ii describe the combustion region 320, and sections iii-viii describe the exhaust region 330.

Several aspects of the sections i-viii are noted here. First, the section areas trend smaller in the direction of flow through the passageway 310. Thus, for example, the sections v-vii each have an area smaller than the section i. Also, the area of the section viii is smaller than the area of the section iv. Second, the section iii includes a re-entrant profile, in which the sectional width, e.g. width in the z direction, has a local minimum in a central region. Third, the section v immediately before the U-bend 350 has a smaller area than the section vi immediately following the U-bend 350.

The relationships between the areas of the sections i-viii are believed to result in advantageous heat transfer characteristics of the heat exchanger 300. For example, the re-entrant profile of the section iii increases the area available in the U-bend 340 for heat transfer to the airstream 270, and may help channel hot gases to the edges of the passageway 310 for increased heat transfer to the airstream 270. The large area is advantageous as this region of the passageway 310 is at or near the highest temperature thereof during operation. In another example, the narrowing of the passageway 310 between the section iv and the section vi may result in a flow characteristic within the U-bend 350 that increase the transfer of heat from the exhaust gas to the heat exchanger 300 surface within the U-bend 350, and thereby to the airstream 270.

In one aspect, the passageway 310 has a width, e.g. an extent of an interior thereof in the z-direction of FIGS. 3 and 4A. Referring to FIG. 4A, sections A-A, B-B and C-C have a maximum width of $W_1$, $W_4$ and $W_7$, respectively. The widths $W_1$, $W_4$ and $W_7$ are not limited to any particular value, but may be constrained by system-level design choices, such as the number of heat exchangers 210 to be located within the heat exchanger assembly 160. In an illustrative embodiment, $W_1$, $W_4$ and $W_7$ are each about equal to 2.5 cm. (See Table I.) In an embodiment, $W_1$, $W_4$ and $W_7$ each fall within a range from about 2.25 cm to about 2.75 cm, inclusive of endpoints. In same cases, a range of about 2.35 cm to about 2.62 cm is preferred, while in some cases a range of about 2.45 to about 2.55 is more preferred.

The heat exchanger 300 may be characterized by an overall width, e.g. a maximum dimension in the z-direction of FIG. 3. In some cases the overall width may be the largest of $W_1$, $W_4$ and $W_7$. The heat exchanger 300 may also be characterized by a width ratio of the overall width to the height 390. In various embodiments, this ratio may be in a range from about 0.10 to about 0.14, inclusive of endpoints. For example, in various embodiments described above, H may be about 21.5 cm, and the overall width may be about 2.5 cm. Thus, the overall width divided by the height 390 is about 0.116 in this example.

In various embodiments a width ratio between 0.10 and 0.14, and an aspect ratio ≤0.5 is expected to allow for an advantageously compact and efficient design of the furnace 100. The various heat exchanger 300 features described herein advantageously enable ≥70% efficiency of the heat exchanger 300 while achieving a compact design of the heat exchanger 300. A width ratio below 0.15 makes possible the placement of a greater number of heat exchangers 210 within a given space than would be possible with a conventional heat exchanger design. The placement of a greater number of heat exchangers 210 advantageously provides for a design of the furnace 100 with a high heat output in a more compact design than would be possible with a conventional heat exchanger design.

Figure 5:
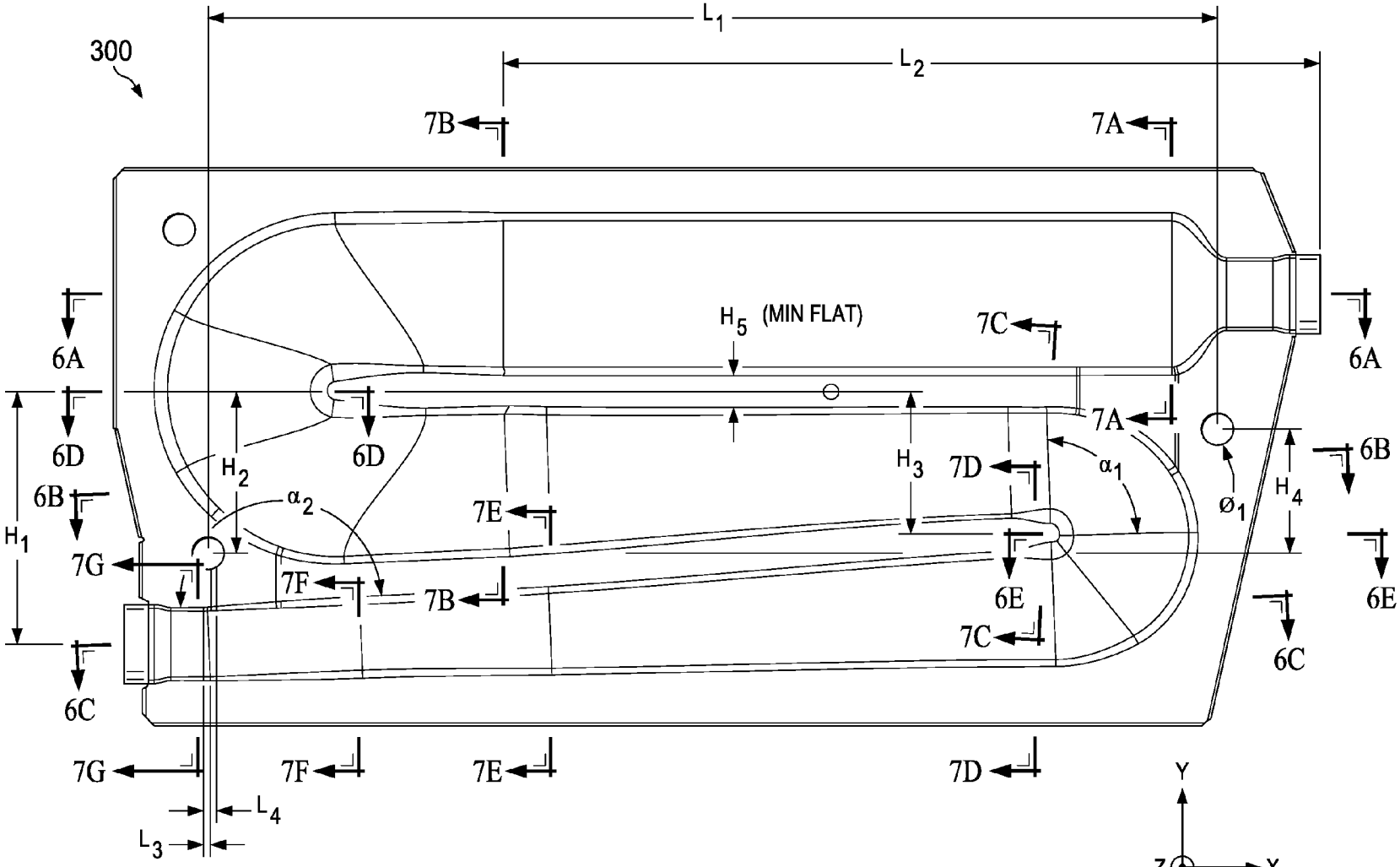

FIG. 5 illustrates another depiction of the heat exchanger 300, with various dimension references and cross-section locations referenced therein. Cross-sections 6A-6E are generally horizontal (in the x-direction of the illustrated coordinate axes), while cross-sections 7A-7G are generally vertical (in the y-direction. Cross-sections 6A-6E are illustrated in FIGS. 6A-6E, respectively, and cross-sections 7A-7G are illustrated in FIGS. 7A-7G, respectively.

Table II presents without limitation illustrative dimensions corresponding to various dimension references in FIGS. 5, 6A-6E and 7A-7G. In one embodiment, the heat exchanger 300 formed according to the values in Table II has a volume, e.g. the internal volume of the passageway 310, of about 932 cc (about 57 $in^3$).

Table II includes an example range, a preferred range and a more preferred range for each dimensional reference. The specific values are presented without limitation by way of example of an illustrative embodiment of the heat exchanger 300. Those skilled in the pertinent art will appreciate that values provided in Table II may be modified without departing from the scope of the disclosure and the claims.

TABLE II

| FIGS. 5, 6 and 7 Illustrative Dimensions | | | | |
|---|---|---|---|---|
| Dimension | Nominal Value (cm) | Example Tolerance (mm) | Preferred Tolerance (mm) | More Preferred Tolerance (mm) |
| $L_1$ | 39.65 | ±2.0 | ±1.3 | ±0.76 |
| $L_2$ | 32.09 | ±2.0 | ±1.3 | ±0.76 |
| $L_3$ | 0.12 | ±2.0 | ±1.3 | ±0.76 |
| $L_4$ | 0.20 | ±2.0 | ±1.3 | ±0.76 |
| $H_1$ | 9.97 | ±2.0 | ±1.3 | ±0.76 |
| $H_2$ | 6.40 | ±2.0 | ±1.3 | ±0.76 |
| $H_3$ | 5.67 | ±2.0 | ±1.3 | ±0.76 |
| $H_4$ | 4.87 | ±2.0 | ±1.3 | ±0.76 |
| $H_5$ | 1.22 | +2.5<br>−0.2 | +1.3<br>−1.3 | +0.2<br>−0.0 |
| $\alpha_1$ | 86° | ±4° | ±1° | ±0.5° |
| $\alpha_2$ | 178° | ±4° | ±1° | ±0.5° |
| $Ø_1$ | 1.45 | ±2.0 | ±1.5 | ±1.3 |

TABLE II-continued

| FIGS. 5, 6 and 7 Illustrative Dimensions | | | | |
|---|---|---|---|---|
| Dimension | Nominal Value (cm) | Example Tolerance (mm) | Preferred Tolerance (mm) | More Preferred Tolerance (mm) |
| $W_1$ | 1.16 | ±2.0 | ±1.3 | ±0.8 |
| $W_2$ | 1.22 | ±2.0 | ±1.3 | ±0.8 |
| $W_3$ | 0.76 | ±1.5 | ±0.8 | +0.8<br>−0.0 |
| $W_4$ | 0.76 | ±1.5 | ±0.8 | +0.8<br>−0.0 |
| $W_5$ | 1.04 | ±2.0 | ±1.3 | ±0.8 |
| $W_6$ | 1.24 | +0.5<br>−0.5 | +0.2<br>−0.2 | +0.2<br>−0.0 |
| $W_7$ | 0.83 | ±2.0 | ±1.3 | ±0.8 |
| $W_8$ | 1.21 | ±2.0 | ±1.3 | ±0.8 |
| $W_9$ | 1.21 | ±2.0 | ±1.3 | ±0.8 |
| $W_{10}$ | 1.24 | ±2.0 | ±1.3 | ±0.8 |
| $W_{11}$ | 0.79 | ±2.0 | ±1.3 | ±0.8 |
| $W_{12}$ | 1.04 | ±2.0 | ±1.3 | ±0.8 |
| $W_{13}$ | 0.79 | ±2.0 | ±1.3 | ±0.8 |
| $W_{14}$ | 0.99 | ±2.0 | ±1.3 | ±0.8 |
| $W_{15}$ | 1.24 | ±2.0 | ±1.3 | ±0.8 |
| $H_1$ | 6.50 | ±2.5 | ±1.3 | ±0.8 |
| $H_2$ | 5.92 | ±2.5 | ±1.3 | ±0.8 |
| $H_3$ | 5.91 | ±2.0 | ±1.3 | ±0.8 |
| $H_4$ | 5.63 | ±2.0 | ±1.3 | ±0.8 |
| $H_5$ | 4.10 | ±2.5 | ±1.3 | ±0.8 |
| $H_6$ | 4.28 | ±2.5 | ±1.3 | ±0.8 |
| $H_7$ | 3.11 | ±2.5 | ±1.3 | ±0.8 |
| $H_8$ | 2.75 | ±2.5 | ±1.3 | ±0.8 |
| $H_9$ | 2.59 | ±2.5 | ±1.3 | ±0.8 |
| $R_1$ | 0.71 | ±0.3 | ±0.2 | ±0.1 |
| $R_2$ | 2.86 | ±0.5 | ±0.4 | ±0.2 |
| $R_3$ | 1.21 | ±0.3 | ±0.2 | ±0.1 |
| $R_4$ | 3.91 | ±0.5 | ±0.4 | ±0.2 |
| $R_5$ | 2.85 | ±0.3 | ±0.2 | ±0.1 |
| $R_6$ | 0.43 | ±0.3 | ±0.2 | ±0.1 |
| $R_{Y7}$ | 2.86 | ±0.5 | ±0.4 | ±0.2 |
| $R_{Z8}$ | 1.21 | ±0.3 | ±0.2 | ±0.1 |
| $R_9$ | 1.03 | ±0.3 | ±0.2 | ±0.1 |
| $R_{Y10}$ | 2.54 | ±0.3 | ±0.2 | ±0.1 |
| $R_{Z11}$ | 1.19 | ±0.3 | ±0.2 | ±0.1 |
| $R_{12}$ | 3.00 | ±0.5 | ±0.4 | ±0.2 |
| $R_{13}$ | 2.63 | ±0.5 | ±0.4 | ±0.2 |
| $R_{14}$ | 1.90 | ±0.3 | ±0.2 | ±0.1 |
| $R_{15}$ | 1.37 | ±0.3 | ±0.2 | ±0.1 |
| $R_{16}$ | 1.24 | ±0.3 | ±0.2 | ±0.1 |
| $R_{17}$ | 0.21 | ±0.3 | ±0.2 | ±0.1 |

One advantageous feature of the passageway 310 is illustrated by the progression of FIG. 7A through FIG. 7G. As combustion and exhaust gases move through the passageway 310, the cross-sectional area of the passageway 310 decreases as the gases cool. As the gases cool, the density of the gases increases. The decrease of cross-sectional area with increasing gas density may provide for a relatively constant gas velocity as the gases flow through the passageway 310. A constant gas flow rate may advantageously improve the efficiency of the heat exchanger 300 and/or simplify analysis of the heat flow characteristics of the heat exchanger 300.

Figure 8:
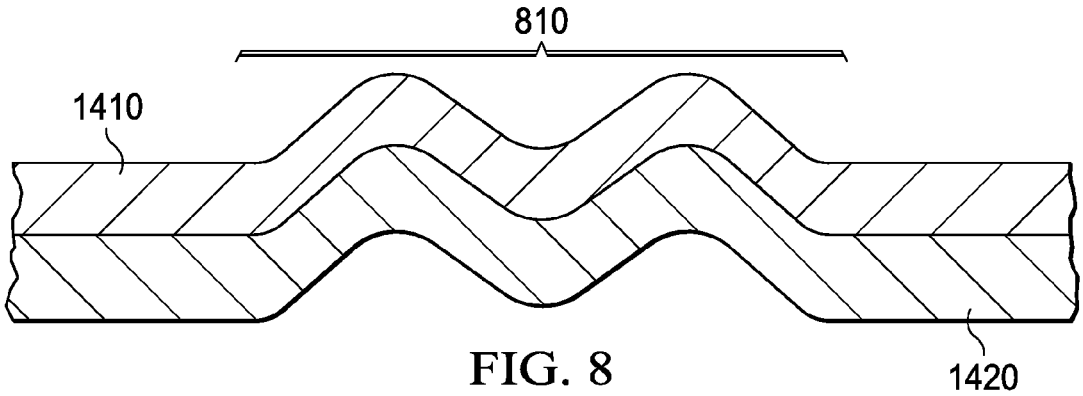
FIG. 8 illustrates an interference pattern that may be located in a seal region according to one embodiment of a heat exchanger, e.g. the heat exchanger of FIG. 3.

FIG. 8 illustrates an interference pattern 810 that may optionally be placed within the seal regions 360, 370 to reduce gas leakage between portions of the passageway 310. In some cases the seal regions 360, 370 may be narrow enough that even with an interference between the seal regions 360, 370 the seal formed thereby is not sufficient to provide a desired efficiency of the heat exchanger 300 because of leakage therethrough. It is expected that such leakage would typically reduce the efficiency of the heat exchanger 300. In one embodiment the interference pattern is a w-crimp that includes an interlocking deformation of the clamshell halves 1410, 1420. It is thought that the multiple undulations of the interference pattern 810 provide greater resistance to gas seepage than a flat meeting surface between the clamshell halves. The interference pattern 810 may be formed, e.g. by a stamping operation after joining the clamshell halves.

Figure 9:
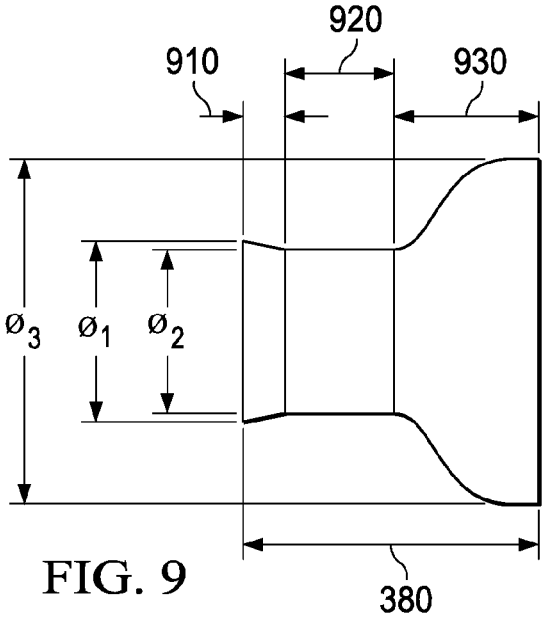
FIG. 9 illustrates a venturi inlet according to one embodiment of a heat exchanger, e.g. the heat exchanger of FIG. 3.

FIG. 9 illustrates a detail view of the inlet region 380 (FIG. 3). As described previously, the inlet region 380 provides an initial path for a burning fuel/air mixture to enter the combustion region 320. The inlet region 380 as illustrated includes a first portion 910, a second portion 920 and a third portion 930. The first portion 910 in the illustrated embodiment has an initial diameter $ø_1$, and narrows to a second smaller diameter $ø_2$ at the boundary between the portions 910, 920. Illustratively the portion 920 has a substantially constant diameter of $ø_2$. Illustratively the third portion 930 widens from $ø_2$ to $ø_3$.

The inlet region 380 may have a substantially circular sectional profile within the portion 910, 920. The third portion 930 may then transition to the profile exemplified by section i of FIG. 4B, with a vertical axis, e.g. in the y-direction axis of the illustrated coordinate axes illustrated in FIG. 3, thus providing a smooth transition from the inlet 240 to the combustion region 320. Illustrative values of the dimensions of the inlet region 380 are tabulated without limitation in Table III. Those skilled in the pertinent art will appreciate that modifications, such as scaling, and changing the ratios of various dimensions, may be performed while without departing from the scope of the disclosure and the claims.

It is believed that the illustrated profile characteristics of the inlet region 380, e.g. a passageway with an initial diameter narrowed to a second smaller value, then transitioning to the sectional profile of the combustion region 320, causes the inlet region 380 to act as a venturi. Such a profile is referred to herein an in the claims as a venturi profile. The venturi profile is expected to initially accelerate the flow of burning fuel as it enters the passageway 310. It is thought that this acceleration, and subsequent transition to a slower flow regime within the wider combustion region 320, results in advantageous flow characteristics of the burning fuel within the combustion region 320. The flow characteristics are further thought to increase combustion efficiency and the transfer of heat to the walls of the heat exchanger 300.

While the presence of the venturi profile is expected to be beneficial in various embodiments, embodiments of the disclosure are not limited to the presence of the venturi profile. For example, in some embodiments $ø_1$ is about equal to $ø_2$, e.g. the first portion 910 has about a constant diameter. In some embodiments the diameter of the inlet region 380 smoothly decreases from an initial value at the beginning of the first portion 910 to a final value at the end of the portion 920. In another embodiment, the diameter of the first portion 910 is about constant, and the diameter of the portion 920 decreases from an initial value at the beginning of the portion 920 to a smaller value at the end of the portion 920.

TABLE III

| FIG. 9 Illustrative Dimensions | | | | |
|---|---|---|---|---|
| Dimension | Nominal Value (cm) | Example Tolerance (mm) | Preferred Tolerance (mm) | More Preferred Tolerance (mm) |
| $ø_1$ | 2.54 | ±1.5 | ±1.2 | ±0.7 |
| $ø_2$ | 2.00 | ±1.5 | ±1.2 | ±0.7 |
| $ø_3$ | 5.80 | ±1.5 | ±1.2 | ±0.7 |
| 910 | 0.66 | ±1.5 | ±1.2 | ±0.7 |
| 920 | 1.85 | ±1.5 | ±1.2 | ±0.7 |
| 930 | 2.21 | ±1.5 | ±1.2 | ±0.7 |

Figure 10A:
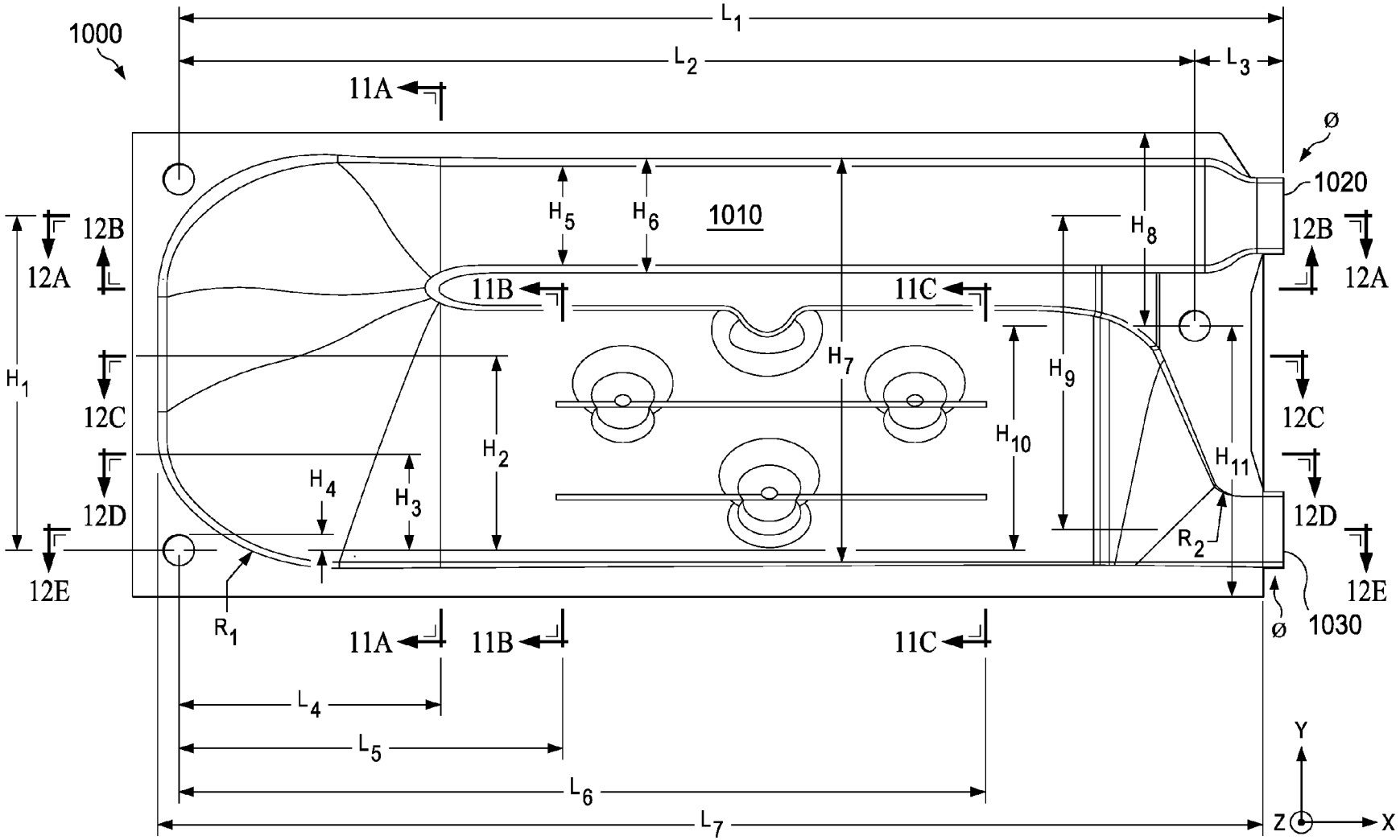
FIGS. 10A-10B, 11A-11C and 12A-12E with Table IV present various illustrative dimensions of a U-type heat exchanger.
Figure 11C:
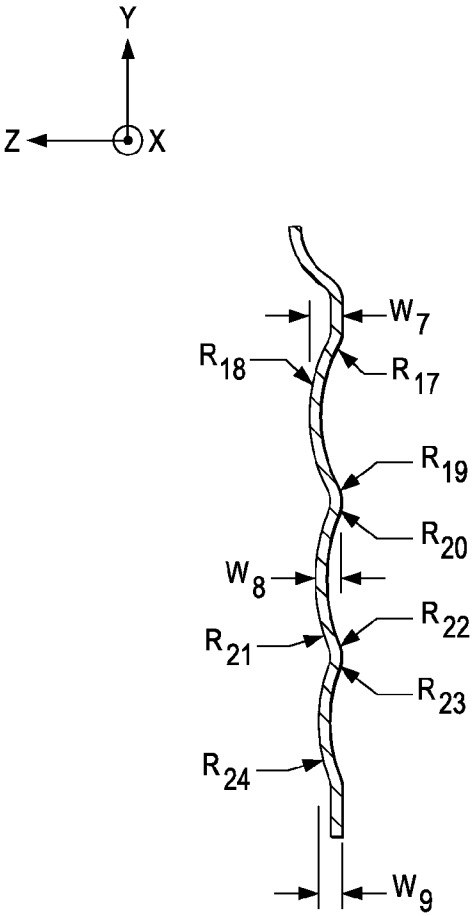
Figure 11B:
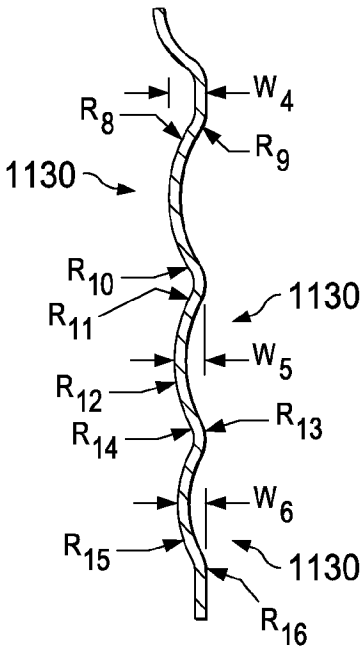
Figure 11A:
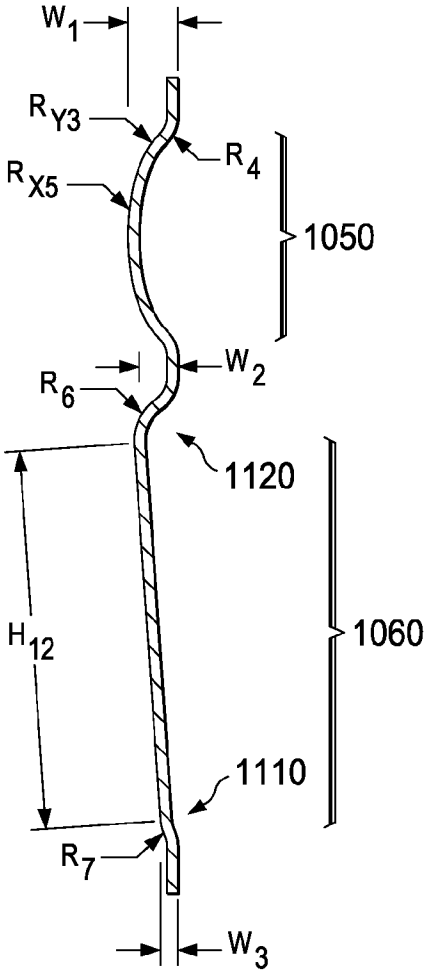
Figure 12A:
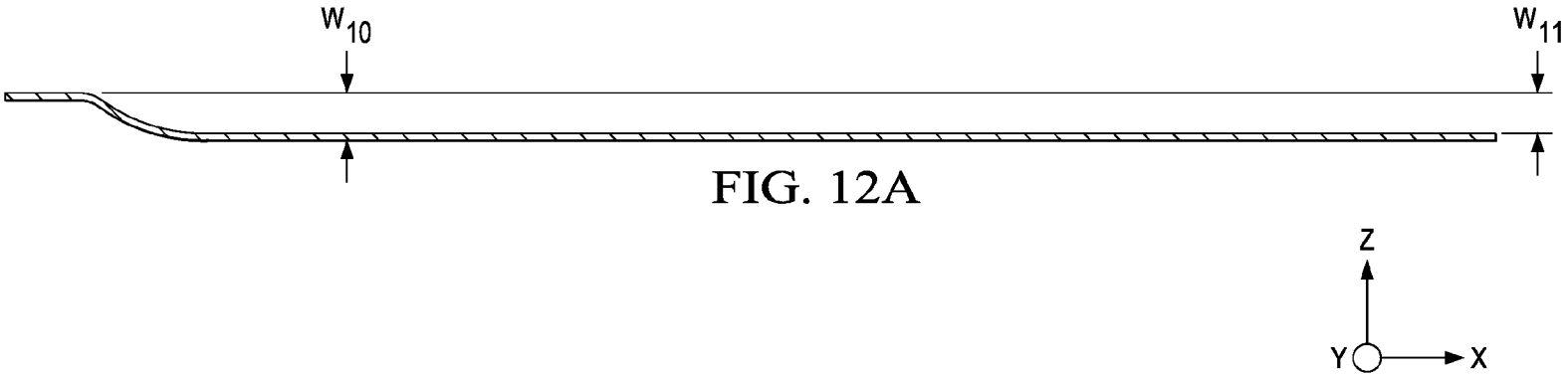
Figure 12B:
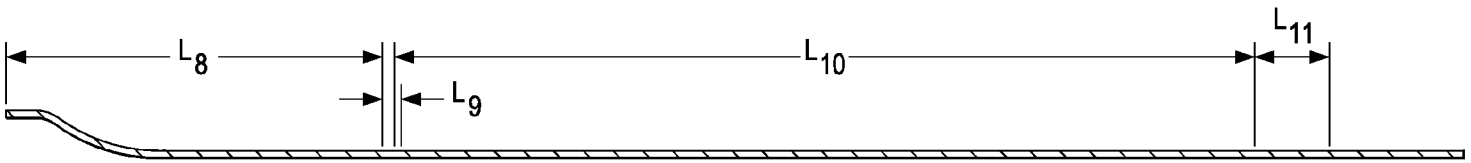
Figure 12C:
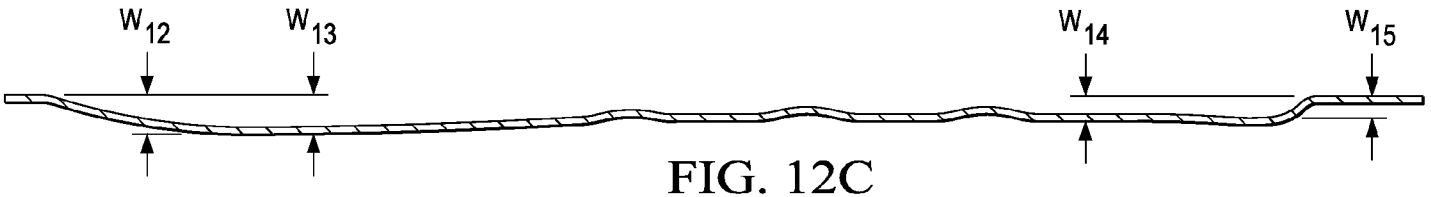
Figure 12D:
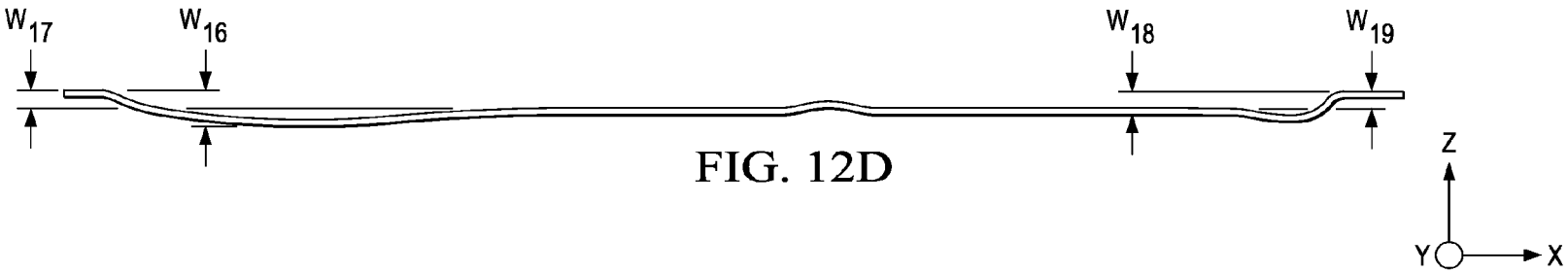
Figure 12E:
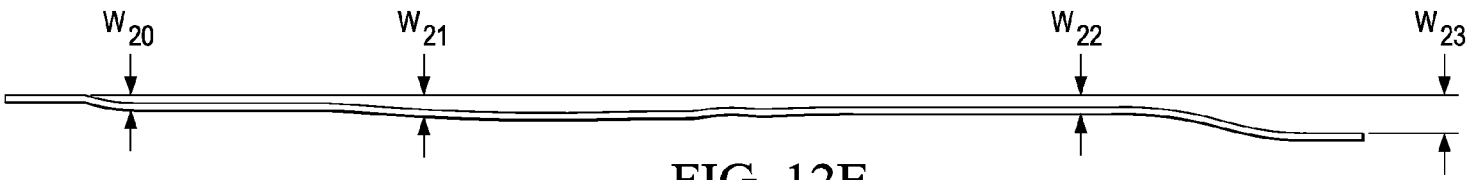

Turning now to FIG. 10A, illustrated is a heat exchanger 1000 that represents an alternate embodiment of a heat exchanger of the disclosure. The heat exchanger 1000 is illustrative of a "U-type" heat exchanger. A passageway 1010 includes an inlet 1020 and an outlet 1030. The heat exchanger 1000 includes an odd number of U-bends, e.g. one. The inlet 1020 and the outlet 1030 are thus located on a same side of the heat exchanger 1000. Geometrical details of the heat exchanger 1000 may be understood by reference to FIGS. 11A-11C and FIGS. 12A-12E, which include various cross-sectional diagrams of portions of the heat exchanger 1000. FIGS. 11A-11C provide illustrative vertical (y-direction) cross-sections as marked in FIG. 10A, and FIGS. 12A-12E provide illustrative horizontal (x-direction) cross-sections as marked in FIG. 10A. In various embodiments the inlet 1020 and the outlet 1030 have about a circular cross-section with a diameter ϕ of about 2.5 cm (1 inch). In various embodiments the heat exchanger 1000 achieves an efficiency of at least about 70% in a compact design by virtue of the design aspects described herein. In some embodiments the heat exchanger 1000 may have an efficiency of at least about 80%.

The various cross-sections 11A-11C and 12A-12E describe an illustrative embodiment of the heat exchanger 1000 without limitation to the scope of the disclosure. Table IV presents without limitation illustrative dimensions corresponding to various dimension references in FIGS. 10, 11A-11C and 12A-12E. The cross-sections may illustrate various linear dimensions, degrees of curvature and structural features such as bosses and indentations of the heat exchanger 1000. Those skilled in the pertinent art will appreciate that various modifications of the illustrated embodiment may be practiced while not departing from the scope of the disclosure and the claims.

TABLE IV

FIGS. 10A, 11 and 12 Illustrative Dimensions

| Dimension | Nominal Value (cm) | Example Tolerance (mm) | Preferred Tolerance (mm) | More Preferred Tolerance (mm) |
|---|---|---|---|---|
| $L_1$ | 48.32 | ±2.0 | ±1.3 | ±0.8 |
| $L_2$ | 44.29 | ±2.0 | ±1.3 | ±0.8 |
| $L_3$ | 4.03 | ±2.0 | ±1.3 | ±0.8 |
| $L_4$ | 11.42 | ±2.0 | ±1.3 | ±0.8 |
| $L_5$ | 16.12 | ±2.0 | ±1.3 | ±0.8 |
| $L_6$ | 35.25 | ±2.0 | ±1.3 | ±0.8 |
| $L_7$ | 48.12 | ±2.0 | ±1.3 | ±0.8 |
| $L_8$ | 13.21 | ±2.0 | ±1.3 | ±0.8 |
| $L_9$ | 0.39 | ±2.0 | ±1.3 | ±0.8 |
| $L_{10}$ | 29.51 | ±2.0 | ±1.3 | ±0.8 |
| $L_{11}$ | 1.78 | ±2.0 | ±1.3 | ±0.8 |
| $H_1$ | 16.08 | ±2.0 | ±1.3 | ±0.8 |
| $H_2$ | 9.37 | ±2.0 | ±1.3 | ±0.8 |
| $H_3$ | 4.75 | ±2.0 | ±1.3 | ±0.8 |
| $H_4$ | 0.62 | ±2.0 | ±1.3 | ±0.8 |
| $H_5$ | 5.76 | ±2.0 | ±1.3 | ±0.8 |
| $H_6$ | 6.39 | ±2.0 | ±1.3 | ±0.8 |
| $H_7$ | 20.26 | ±2.0 | ±1.3 | ±0.8 |
| $H_8$ | 9.91 | ±2.0 | ±1.3 | ±0.8 |
| $H_9$ | 15.60 | ±2.0 | ±1.3 | ±0.8 |
| $H_{10}$ | 10.80 | ±2.0 | ±1.3 | ±0.8 |
| $H_{11}$ | 13.31 | ±2.0 | ±1.3 | ±0.8 |
| $H_{12}$ | 10.70 | ±2.0 | ±1.3 | ±0.8 |
| $W_1$ | 1.21 | ±2.0 | ±1.3 | ±0.8 |
| $W_2$ | 0.98 | ±2.0 | ±1.3 | ±0.8 |
| $W_3$ | 0.25 | ±2.0 | ±1.3 | ±0.8 |
| $W_4$ | 0.74 | ±2.0 | ±1.3 | ±0.8 |
| $W_5$ | 0.53 | ±2.0 | ±1.3 | ±0.8 |
| $W_6$ | 0.46 | ±2.0 | ±1.3 | ±0.8 |
| $W_7$ | 0.53 | ±2.0 | ±1.3 | ±0.8 |
| $W_8$ | 0.38 | ±2.0 | ±1.3 | ±0.8 |

TABLE IV-continued

FIGS. 10A, 11 and 12 Illustrative Dimensions

| Dimension | Nominal Value (cm) | Example Tolerance (mm) | Preferred Tolerance (mm) | More Preferred Tolerance (mm) |
|---|---|---|---|---|
| $W_9$ | 0.23 | ±2.0 | ±1.3 | ±0.8 |
| $W_{10}$ | 1.21 | ±2.0 | ±1.3 | ±0.8 |
| $W_{11}$ | 1.24 | ±2.0 | ±1.3 | ±0.8 |
| $W_{12}$ | 1.03 | ±2.0 | ±1.3 | ±0.8 |
| $W_{13}$ | 0.93 | ±2.0 | ±1.3 | ±0.8 |
| $W_{14}$ | 0.51 | ±2.0 | ±1.3 | ±0.8 |
| $W_{15}$ | 0.68 | ±2.0 | ±1.3 | ±0.8 |
| $W_{16}$ | 0.79 | ±2.0 | ±1.3 | ±0.8 |
| $W_{17}$ | 0.52 | ±2.0 | ±1.3 | ±0.8 |
| $W_{18}$ | 0.36 | ±2.0 | ±1.3 | ±0.8 |
| $W_{19}$ | 0.49 | ±2.0 | ±1.3 | ±0.8 |
| $W_{20}$ | 0.32 | ±2.0 | ±1.3 | ±0.8 |
| $W_{21}$ | 0.45 | ±2.0 | ±1.3 | ±0.8 |
| $W_{22}$ | 0.33 | ±2.0 | ±1.3 | ±0.8 |
| $W_{23}$ | 1.24 | ±2.0 | ±1.3 | ±0.8 |
| $R_1$ | 7.77 | ±2.0 | ±1.3 | ±0.8 |
| $R_2$ | 1.27 | ±2.0 | ±1.3 | ±0.8 |
| $R_{Y3}$ | 2.86 | ±2.0 | ±1.3 | ±0.8 |
| $R_4$ | 0.43 | ±2.0 | ±1.3 | ±0.8 |
| $R_{Z5}$ | 1.21 | ±2.0 | ±1.3 | ±0.8 |
| $R_6$ | 1.27 | ±2.0 | ±1.3 | ±0.8 |
| $R_7$ | 0.53 | ±2.0 | ±1.3 | ±0.8 |
| $R_8$ | 3.41 | ±2.0 | ±1.3 | ±0.8 |
| $R_9$ | 0.43 | ±2.0 | ±1.3 | ±0.8 |
| $R_{10}$ | 0.48 | ±2.0 | ±1.3 | ±0.8 |
| $R_{11}$ | 0.48 | ±2.0 | ±1.3 | ±0.8 |
| $R_{12}$ | 4.32 | ±2.0 | ±1.3 | ±0.8 |
| $R_{13}$ | 0.48 | ±2.0 | ±1.3 | ±0.8 |
| $R_{14}$ | 0.48 | ±2.0 | ±1.3 | ±0.8 |
| $R_{15}$ | 2.98 | ±2.0 | ±1.3 | ±0.8 |
| $R_{16}$ | 0.18 | ±2.0 | ±1.3 | ±0.8 |
| $R_{17}$ | 0.48 | ±2.0 | ±1.3 | ±0.8 |
| $R_{18}$ | 4.52 | ±2.0 | ±1.3 | ±0.8 |
| $R_{19}$ | 0.48 | ±2.0 | ±1.3 | ±0.8 |
| $R_{20}$ | 0.48 | ±2.0 | ±1.3 | ±0.8 |
| $R_{21}$ | 5.98 | ±2.0 | ±1.3 | ±0.8 |
| $R_{22}$ | 0.48 | ±2.0 | ±1.3 | ±0.8 |
| $R_{23}$ | 0.48 | ±2.0 | ±1.3 | ±0.8 |
| $R_{24}$ | 5.51 | ±2.0 | ±1.3 | ±0.8 |
| ϕ | 2.54 | ±2.0 | ±1.0 | ±0.5 |

Figure 10B:
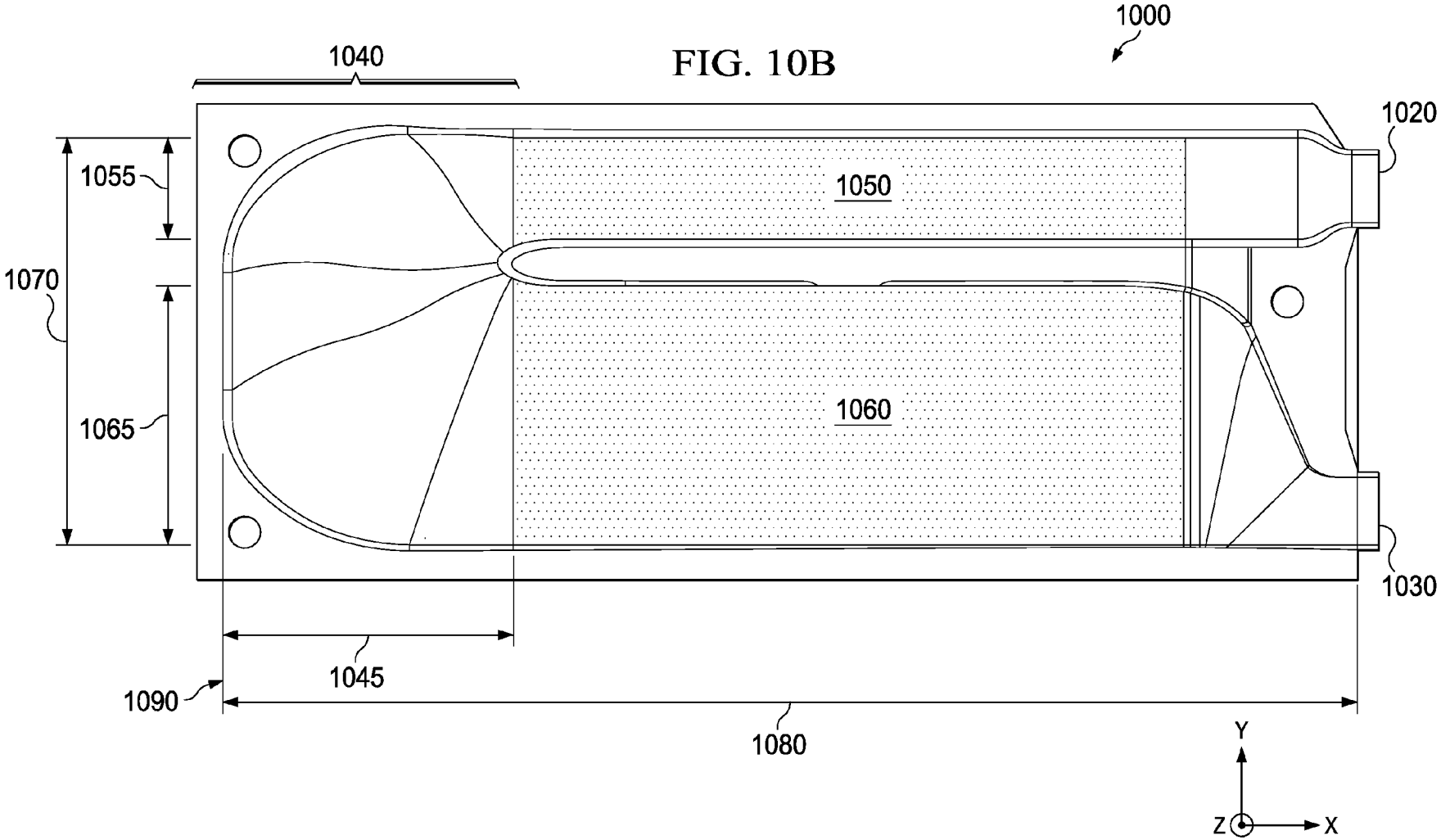

FIG. 10B illustrates the heat exchanger 1000 in simplified form for clarity. Among the features of the heat exchanger 1000 is a U-bend 1040 that connects a combustion region 1050 to an exhaust region 1060. The U-bend 1040 has a width 1045. The combustion region 1050 has an initial width 1055 that in the illustrated embodiment is substantially constant over the length of the combustion region 1050. The exhaust region 1060 has a width 1065. In various embodiments, the U-bend 1040 is configured to reduce a velocity of exhaust gases that enter the U-bend 1040 from the combustion region 1050 such as by the illustrative widening from the width 1045 to the width 1055. It is believed that by such slowing of the velocity the residence time of the exhaust gases is increased, allowing more time for air flow, e.g. the airstream 270, to remove heat from the exhaust gases. In various embodiments a bend ratio of the width 1045 divided by the width 1055 is at least about 1.5. In some embodiments the bend ratio has a preferred value in a range of about 1.5 to about 2.0, inclusive. In some embodiments the bend ratio has a preferred nominal value of about 2. In a nonlimiting example, the width 1045 is about equal to $L_4$, and $W_2$ is about equal to $H_5$ (FIG. 10A and Table IV). Using illustrative values from Table IV yields a bend ratio of about 1.98.

The passageway 1010 has a height 1070 and a depth 1080. The height 1070 is defined as for the heat exchanger 300, e.g. from a bottom vertical extent to a top vertical extent (y-direction) of the passageway 1010. The depth 1080 in the context of the heat exchanger 1000 is the distance between the inlet 1020 or outlet 1030 and the horizontal (x-direction) extent of the passageway 1010, e.g. about at a reference line 1090 (FIG. 10B). In the context of the heat exchanger 1000, an aspect ratio may be defined as the height 1070 divided by the depth 1080. In various embodiments the aspect ratio is about 0.5 or less. In a nonlimiting example, the height 1070 is about equal to $H_9$+½ $H_5$+½ ϕ, and the depth 1080 is about equal to $L_7$. Referencing Table IV, H/D is about 0.47 for this example.

In some embodiments, such as that illustrated in FIG. 11A, a cross-sectional width of the exhaust region 1060 increases monotonically from an initial width $W_3$ adjacent a side 1110 opposite the combustion region 1050 to about $W_2$ at a side 1120 adjacent the combustion region 1050. In other words, the cross-sectional width of the exhaust region 1060 increases in a positive-y direction. In some embodiments, such as that illustrated in FIG. 11B, the exhaust region 1060 includes one or more bosses 1130 to define subchannels, e.g. roughly parallel passages within the exhaust region 1060 that guide the exhaust with little or no mixing between subchannels. Such subchannels may advantageously act to increase the heat transfer surface area of the heat exchanger 1000.

The various innovative design features as described herein make possible achieving a high efficiency, compact design of the heat exchanger 210. The use of such design features makes possible in some embodiments a serpentine heat exchanger such as the heat exchanger 300 having least 70% efficiency with an aspect ratio of about 0.5 or less. One embodiment described herein, e.g. the serpentine heat exchanger 300, may have a height of about 21.3 cm (8.4 inches) and a depth of about 46.2 cm (18.2 inches). Another embodiment described herein, e.g. the U-type heat exchanger 1000, may have a height of about 23.2 cm (9.1 inches) and a depth of about 50.6 cm (19.9 inches), with an efficiency of about 80%.

Figure 13:
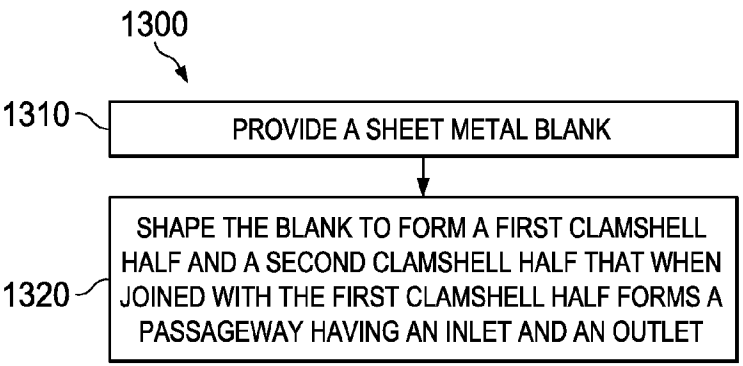
FIG. 13 presents a method of manufacturing a furnace, e.g. the furnace 100 of FIG. 1.

Turning to FIG. 13, a method 1300 of manufacturing a heat exchanger, e.g. the heat exchanger 300, is set forth. In a step 1310, a sheet metal blank is provided. Herein and in the claims, the term "provided" means that a mechanical component, structural element, etc., may be manufactured by the individual or business entity performing the disclosed methods, or obtained thereby from a source other than the individual or entity, including another individual or business entity. The sheet metal blank may be, e.g. any of the sheet metal types previously described, e.g., 0.73 mm aluminized steel.

In a step 1320, the sheet metal blank is shaped to form first and second clamshell halves, e.g. the clamshell halves 1410, 1420. The shaping may be by any conventional or novel method, such as stamping. The clamshell halves each include a passageway half that when joined form a passageway with an inlet and an outlet. The clamshell halves 1410, 1420 may have any combination of bosses and indentations, for example the various features described herein in FIGS. 5, 6A-6E, 7A-7G, 8, 9 10A, 10B, 11A-11C, and 12A-12E. The passageway has a height and a depth. A ratio of the height to the depth is about 0.5 or less, and the heat exchanger has an efficiency of at least about 70%.

Optionally, the passageway includes a serpentine path. Optionally the passageway includes a combustion region that has a re-entrant sectional profile. Optionally, the passageway includes a venturi at the inlet. Optionally, a cross-sectional area of the passageway decreases in a direction of gas flow in the passageway. Optionally the passageway has a width, where a ratio of the width to the height is in a range of about 0.10 to about 0.14. Optionally an interference pattern is located in a seal region between the portions of the passageway. Optionally the region includes a U-bend that connects a combustion region to an exhaust region, with the U-bend having a width at least 1.5 times a width of the combustion region.

Although the present invention has been described in detail, those skilled in the art should understand that they can make various changes, substitutions and alterations herein without departing from the spirit and scope of the invention in its broadest form.

What is claimed is:

1. A clamshell heat exchanger for use in a gas-fired direct combustion furnace, comprising:

a first clamshell half; and a second clamshell half that when joined with said first clamshell half forms a passageway having an inlet and an outlet, wherein said passageway includes a U-bend located between said inlet and said outlet, wherein said passageway includes a second U-bend between said U-bend and said outlet, said second U-bend located on an opposing side of said clamshell heat exchanger as said U-bend, and, a cross-sectional area of said passageway progressively narrows over substantially an entire length of said passageway between said U-bend and said second U-bend and further progressively narrows over substantially an entire length of said passageway between said second U-bend and said outlet.

2. The clamshell heat exchanger as recited in claim 1, wherein said passageway is a serpentine path.

3. The clamshell heat exchanger as recited in claim 1, wherein said passageway has a cross-sectional area that narrows in a direction past said U-bend to said outlet.

4. The clamshell heat exchanger as recited in claim 1, wherein a ratio of a cross-sectional width of said passageway to a distance between an uppermost extent and a lowermost extent of said passageway is in a range of about 0.10 to about 0.14.

5. A furnace, comprising:

a cabinet;

a heat exchanger assembly located within said cabinet;

a blower configured to move air through the cabinet and over said heat exchanger assembly; and a clamshell heat exchanger located within said heat exchanger assembly, said clamshell heat exchanger including:

a first clamshell half; and a second clamshell half that when joined with said first clamshell half forms a passageway having an inlet and an outlet, wherein said passageway includes a U-bend located between said inlet and said outlet, wherein said passageway includes a second U-bend between said U-bend and said outlet, said second U-bend located on an opposing side of said clamshell heat exchanger as said U-bend, and, a cross-sectional area of said passageway progressively narrows over substantially an entire length of said passageway between said U-bend and said second U-bend and further progressively narrows over substantially an entire length of said passageway between said second U-bend and said outlet.

6. The furnace as recited in claim 5, wherein said passageway is a serpentine path.

7. The furnace as recited in claim 5, wherein said passageway includes a combustion region that has a re-entrant sectional profile.

8. The furnace as recited in claim 5, further comprising an inlet region adjacent said inlet, said inlet region having a venturi profile.

9. The furnace as recited in claim 5, wherein said passageway has a has a cross-sectional area that narrows in a direction past said U-bend to said outlet.

10. A method of manufacturing a heat exchanger, comprising:

providing a sheet metal blank;

shaping said blank to form a first clamshell half and a second clamshell half that when joined with said first clamshell half forms a passageway having an inlet and an outlet, wherein said passageway includes a U-bend located between said inlet and said outlet, wherein said passageway includes a second U-bend between said U-bend and said outlet, said second U-bend located on an opposing side of said clamshell heat exchanger as said U-bend, and, a cross-sectional area of said passageway progressively narrows over substantially an entire length of said passageway between said U-bend and said second U-bend and further progressively narrows over substantially an entire length of said passageway between said second U-bend and said outlet.

11. The method as recited in claim 10, wherein said passageway is a serpentine path.

12. The method as recited in claim 10, wherein said passageway includes a combustion region that has a re-entrant sectional profile.

13. The method as recited in claim 10, further comprising an inlet region adjacent said inlet, said inlet region having a venturi profile.

14. The method as recited in claim 10, wherein said passageway has a cross-sectional area that narrows in a direction past said U-bend to said outlet.

* * * * *